US005670098A

United States Patent [19]

Dillehay et al.

[11] Patent Number: 5,670,098

[45] Date of Patent: Sep. 23, 1997

[54] BLACK POWDER PROCESSING ON TWIN-SCREW EXTRUDER

[75] Inventors: David R. Dillehay; David W. Turner, both of Marshall, Tex.; Jim Blackwell, Shreveport, La.

[73] Assignee: Thiokol Corporation, Odgen, Utah

[21] Appl. No.: 707,199

[22] Filed: Aug. 20, 1996

[51] Int. Cl.[6] ..... C06B 21/00

[52] U.S. Cl. ..... 261/3.3; 264/3.4; 149/5; 149/72; 149/73; 86/21

[58] Field of Search ..... 149/5, 72, 73; 264/3.3, 3.4; 86/21

[56] References Cited

U.S. PATENT DOCUMENTS

| | | | |
|---|---|---|---|
| H72 | 6/1986 | Wise et al. | 149/61 |
| 1,748,455 | 2/1930 | Olsen . | |
| 1,882,853 | 10/1932 | McIntyre . | |
| 2,423,427 | 7/1947 | Payn et al. | 52/17 |
| 3,265,778 | 8/1966 | Griffith | 264/3 |
| 3,473,982 | 10/1969 | Herzog et al. | 149/20 |
| 3,637,444 | 1/1972 | Bonyata et al. | 149/10 |
| 3,660,546 | 5/1972 | Lovold | 264/3 C |
| 3,890,171 | 6/1975 | Jessop | 149/19.1 |
| 3,903,219 | 9/1975 | Stephanoff | 264/3 C |
| 3,937,770 | 2/1976 | Wiedemann et al. | 264/3 C |
| 3,984,342 | 10/1976 | Hall et al. | 252/186 |
| 4,001,060 | 1/1977 | Staba | 149/109.6 |
| 4,014,655 | 3/1977 | Brunnberg | 23/266 |
| 4,128,443 | 12/1978 | Pawlak et al. | 149/71 |
| 4,377,426 | 3/1983 | Levenson | 149/109.6 |
| 4,456,494 | 6/1984 | Maes et al. | 149/21 |
| 4,497,676 | 2/1985 | Kurtz | 149/2 |
| 4,564,404 | 1/1986 | Frémaux et al. | 149/21 |
| 4,585,600 | 4/1986 | Rollyson et al. | 264/3.3 |
| 4,685,375 | 8/1987 | Ross et al. | 86/20.15 |
| 4,693,765 | 9/1987 | Stromquist et al. | 149/60 |
| 4,756,779 | 7/1988 | Matts | 149/109.6 |
| 4,931,229 | 6/1990 | Krimmel et al. | 264/3.3 |
| 5,114,630 | 5/1992 | Newman et al. | 264/3.1 |
| 5,320,691 | 6/1994 | Weber | 149/61 |
| 5,470,408 | 11/1995 | Nielson et al. | 149/109.6 |
| 5,487,851 | 1/1996 | Dillehay et al. | 264/3.3 |
| 5,565,150 | 10/1996 | Dillehay et al. | 264/3.3 |

*Primary Examiner*—Peter A. Nelson

*Attorney, Agent, or Firm*—Cushman Darby & Cushman IP Group of Pillsbury Madison & Sutro, LLP; Ronald L. Lyons, Esq.

[57] ABSTRACT

A continuous process of manufacturing black powder and black powder substitute using a twin screw extruder is disclosed. Guar gum mixed with the composition at a concentration in the range from 0.05% to 0.5%, by weight, dramatically reduced the friction in the dies and permitted extrusion of the powder at much lower water levels. Different size dies used in combination with face cutting of the extruded strands produce various sized granules. The process can be operated remotely and automatically. The process reduces the number of buildings, equipment and personnel required to manufacture black powder or black powder substitute. The process produces more uniform and reproducible particle sizes.

14 Claims, No Drawings

BLACK POWDER PROCESSING ON TWIN-SCREW EXTRUDER

BACKGROUND OF THE INVENTION

1. Field of the Invention

This invention relates to the processing of black powder. More specifically, the invention uses a continuous twin-screw extruder to reduce the number of process steps and to reduce the exposure of personnel to hazardous steps compared to conventional batch processing of black powder.

2. Technology Background

Black powder is one of the oldest energetic materials known to man. It has been widely used in weaponry for centuries. The basic formulation has not changed in hundreds of years. Black powder consists of a mixture of approximately 72–75 percent potassium nitrate, 15–18 percent charcoal, and 10 percent sulfur. Variations and substitutes of the basic black powder formulation are known or being developed.

Thermodynamic calculations have verified what was determined by trial and error over the centuries, that the optimum formulation of black powder (with minor adjustments for raw material variations) is 75% potassium nitrate, 15% charcoal, and 10% sulfur. The table below shows the calculated impetus for black powder formulations as the components are varied:

| % $KNO_3$ | % S | % C | $\gamma$ | $T_C$, °K. | Impetus ft-lb/lb |
|---|---|---|---|---|---|
| 78 | 10 | 12 | 1.291 | 2156.6 | 86455.8 |
| 77 | 10 | 13 | 1.284 | 2107.3 | 84631.4 |
| 76.5 | 10 | 13.5 | 1.275 | 2084.2 | 82800.0 |
| 76 | 10 | 14 | 1.277 | 2056.8 | 82839.0 |
| 75 | 10 | 15 | 1.248 | 1939.6 | 94188.5 |
| 74.5 | 10 | 15.5 | 1.252 | 1880.0 | 92717.6 |
| 74 | 10 | 16 | 1.257 | 1799.5 | 90327.5 |
| 73 | 10.5 | 16.5 | 1.255 | 1775.1 | 88948.3 |
| 70 | 11 | 19 | 1.277 | 1418.2 | 76276.1 |

It is observed that the maximum impetus is found at the traditional 75/10/15 ratio of the black powder formulation. It may be noted that the measured impetus of black powder is closer to 100,000 ft-lb/lb. The difference between calculated and measured is probably due to the use of charcoal in black powder rather than the carbon used in the calculations. Another interesting feature of the table concerns the observation that the temperature continues to increase although the impetus peaks at the 75% level. This is a function of the gas content and reflects a minimum in the molecular weight and content of the gases in the combustion products. This shows the coincidence with impetus and explains how the impetus can go down even though the temperature increases.

The process for manufacturing black powder is relatively simple but it application is an art. Historically, problems have occurred when processing changes were made in charcoal production for black powder. Changing the type of wood or the manufacturing process used to manufacture the charcoal has resulted in variable performance of the powder. Many black powder substitutes include materials which replace the charcoal.

The currently commercial process for manufacturing black powder involves first ball milling the sulfur and charcoal to obtain an intimate mixture of the two ingredients. This step is essential to the performance of the black powder. Simple mixtures of the three main ingredients will not perform satisfactorily.

The next step is the muller mixing operation. The muller mixers used to make black powder are unique. The steel bed of the muller is floated on a base of melted and solidified sulfur. The sides are wooden and the muller's steel wheels are 10 tons in weight. A charge of potassium nitrate, sulfur and charcoal is placed in the muller and water is added as a processing aid. The mixture is mulled until the consistency is correct by observation, usually 4 to 5 hours. The moisture content after mulling is typically around 3%.

The composition is shoveled into a cart for transfer to the blocking building. The blocking press is a long wooden trough with aluminum plates placed at approximately 4 inch spacing and it is filled with the black powder mixture. A hydraulic press is used to compress the powder into blocks approximately 1 inch thick by 2 feet square. These blocks are manually removed and broken into chunks by a coarse-toothed crusher for transfer to the corning mill.

At the corning mill, sets of wooden rollers break the chunks into coarse particles. The particles are then screened to get the various granulations. Most of the black powder is glazed with graphite in 5000 pound batches in a rotating wooden barrel. The finished product is packed out and stored in magazines prior to shipment. The packout is typically in 25 pound steel cans with a conductive plastic liner.

Because black powder is manufactured in batches, the performance characteristics of each batch are unique. Furthermore, the current manufacturing process is labor intensive. Personnel are required at each of the following process steps:

1. Batch weigh ingredients
2. Ball mill sulfur and charcoal
3. Muller mix with potassium nitrate
4. Block the powder
5. Break the pressed powder into chunks
6. Corning mill to granulate the powder
7. Screen to classify and size the powder
8. Dry the powder
9. Glaze the powder
10. Package the powder Each of the foregoing steps requires personnel to monitor and handle the black powder. Many of these process steps expose the worker to hazardous materials. Steps 4–10 are particularly hazardous. It would be an advancement in the art to provide a process of manufacturing black powder and black powder substitute which reduces the number of process steps and reduces the exposure of personnel to hazardous steps compared to conventional batch processing of black powder.

It would also be a significant advancement in the art to provide a continuous process for manufacturing black powder and black powder substitute which produces a homogenous product.

Such processes of manufacturing black powder and black powder substitute are disclosed and claimed herein.

SUMMARY OF THE INVENTION

The present invention is directed to a continuous process of manufacturing black powder and black powder substitute using a twin screw extruder. Previous attempts at processing black powder with an extruder, using water as a processing aid, failed because the composition could not be extruded at the required density. High friction in the dies prevented extrusion.

Applicants found that a guar gum processing aid at a concentration in the range from 0.05% to 0.5%, by weight, dramatically reduced the friction in the dies and permitted extrusion of the powder at much lower water levels. Other materials similar to guar gum, such as karaya gum and gum tragacanth, can be used in the present invention and are to be included within the scope of guar gum.

Different size dies used in combination with face cutting of the extruded strands produce various sized granules. The process can be operated remotely and automatically. The process reduces the number of buildings, equipment and personnel required to manufacture black powder or black powder substitute. The process produces more uniform and reproducible particle sizes.

DETAILED DESCRIPTION OF THE INVENTION

The invention is directed to a continuous process for making black powder and black powder substitute using a twin screw extruder. The potassium nitrate has a weight percent in the range from 70% to 78%, the sulfur has a weight percent in the range from 7% to 12%, the fuel has a weight percent in the range from 15%–20%, and the guar gum has a weight percent from 0.05% to 0.5%, based upon dry weight of ingredients.

In a preferred embodiment within the scope of the present invention, potassium nitrate and graphite are mixed in a rod mill. The graphite is added to increase the conductivity of the black powder and to retard moisture absorption. The black powder composition will typically include from 0.1% to 0.2% graphite during the milling step. Carbon fibrils, or similar ingredients, can also be used to promote conductivity.

Sulfur, charcoal, and a small amount of guar gum are preferably mixed in a ball mill. The ingredients are provided in the following typical amounts: 10 parts sulfur, 15 parts charcoal and 1 part guar gum. The ingredients are preferably metered into a twin-screw extruder using a loss-in-weight feeder. A small amount of water is added to the extruder, and the ingredients are compounded to form a black powder paste suitable for extrusion. The water functions as a processing aid. It also desensitizes the composition during mixing and extrusion.

The black powder is extruded through a die. The extrusion consolidates the ingredients and can be controlled to vary the density of the resulting black powder. A face cutter is preferably provided to cut the extruded black powder and form black powder granules. A typical length/diameter ratio is about 1:1, although other ratios can be used. The black powder granules are then dried and glazed with graphite for packaging.

The present invention can also be used to process a black powder substitute, such as that disclosed in U.S. Pat. No. 5,320,691 to Weber, which is incorporated by reference. The Weber patent discloses a charcoal free black powder. This composition is processed similarly to the black powder described above, except that the charcoal is replaced with an alcoholic potassium hydroxide solution and phenolphthalein. The alcoholic potassium hydroxide solution is prepared from potassium hydroxide, ethyl alcohol, and water.

Referring to the current batch process described in the Background section, above, steps 4–8 of blocking, breaking, milling, screening, and drying are replaced according to the present invention by the metering of ingredients into the twin screw extruder, compounding, extruding, face cutting, and drying. These steps according to the present invention can be automated and performed remotely without direct personnel control. This results in a safer process to personnel and equipment and to a more predictable, homogeneous product.

From the foregoing it will be appreciated that the present invention provides a process of manufacturing black powder and black powder substitute which reduces the number of process steps and reduces the exposure of personnel to hazardous steps compared to conventional batch processing of black powder. The present invention enables black powder and black powder substitute to be processed remotely, requiring fewer personnel. Because the process according to the present invention enables continuous processing of black powder, it produces a more homogeneous product than current batch processes.

The invention may be embodied in other specific forms without departing from its essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A process for making black powder comprising the steps of:

(a) mixing sulfur and a fuel to form a mixture of sulfur and fuel;

(b) metering potassium nitrate, the mixture of sulfur and fuel, and processing aid selected from guar gum, karaya gum, and gum tragacanth into a twin-screw extruder, wherein the potassium nitrate has a weight percent in the range from 70% to 78%, the sulfur has a weight percent in the range from 7% to 12%, the fuel has a weight percent in the range from 15%–20%, and the guar gum has a weight percent from 0.05% to 0.5%;

(c) adding water to the twin-screw extruder;

(d) compounding the potassium nitrate, sulfur, fuel, guar gum and water to form a black powder mixture;

(e) extruding the black powder mixture through a die;

(f) face cutting the extruded black powder to form black powder granules;

(g) drying the black powder granules; and (h) glazing the black powder granules with graphite.

2. A process for making black powder as defined in claim 1, further comprising the step of mixing potassium nitrate and graphite and wherein the mixture of potassium nitrate and graphite is metered into the twin screw extruder.

3. A process for making black powder as defined in claim 2, wherein the graphite mixed with the potassium nitrate has a concentration in the black powder composition in the range from 0.1% to 0.2% by weight.

4. A process for making black powder as defined in claim 1, wherein the fuel is charcoal.

5. A process for making black powder as defined in claim 1, wherein the fuel is phenolphthalein.

6. A process for making black powder as defined in claim 1, further comprising the step of packaging the glazed black powder granules.

7. A process for making black powder comprising the steps of:

(a) mixing potassium nitrate and graphite to form a potassium nitrate mixture;

(b) mixing sulfur, a fuel, and a processing aid to form a sulfur/fuel mixture;

(c) metering the potassium nitrate mixture and the sulfur/fuel mixture into a twin-screw extruder, wherein the potassium nitrate has a weight percent in the range from 70% to 78%, the sulfur has a weight percent in the range from 7% to 12%, the fuel has a weight percent in the range from 15%–20%, and the processing aid has a weight percent from 0.05% to 0.5%;

(d) adding water to the twin-screw extruder;

(e) compounding the potassium nitrate, sulfur, fuel, processing aid and water to form a black powder mixture;

(f) extruding the black powder mixture through a die;

(g) face cutting the extruded black powder to form black powder granules;

(h) drying the black powder granules; and (i) glazing the black powder granules with graphite.

8. A process for making black powder as defined in claims 7, wherein the processing aid is guar gum.

9. A process for making black powder as defined in claims 7, wherein the processing aid is karaya gum.

10. A process for making black powder as defined in claims 7, wherein the processing aid is gum tragacanth.

11. A process for making black powder as defined in claim 7, wherein the fuel is charcoal.

12. A process for making black powder as defined in claim 7, wherein the fuel is phenolphthalein.

13. A process for making black powder as defined in claim 7, further comprising the step of packaging the glazed black powder granules.

14. A process for making black powder as defined in claim 7, wherein the graphite mixed with the potassium nitrate has a concentration in the black powder composition in the range from 0.1% to 0.2% by weight.

* * * * *